US006274519B1

(12) United States Patent
Omori et al.

(10) Patent No.: US 6,274,519 B1
(45) Date of Patent: Aug. 14, 2001

(54) FOOD WRAPPING CLOTH

(76) Inventors: Michiko Omori, 18-18-517, Nangu-cho, Ashiya-shi, Hyougo, 659-0024; Sataro Shimazaki, 11-16-307, Tatsumi-minami, 3-chome, Ikuno-ku, Osaka-Shi, Osaka 544-0015, both of (JP)

( * ) Notice: Subject to any disclaimer, the term of this patent is extended or adjusted under 35 U.S.C. 154(b) by 0 days.

(21) Appl. No.: 09/284,476

(22) PCT Filed: Aug. 21, 1998

(86) PCT No.: PCT/JP98/03731

§ 371 Date: Jun. 14, 1999

§ 102(e) Date: Jun. 14, 1999

(87) PCT Pub. No.: WO99/10577

PCT Pub. Date: Mar. 4, 1999

(30) Foreign Application Priority Data

Aug. 21, 1997 (JP) ..... 9/225388
Dec. 2, 1997 (JP) ..... 9/331562

(51) Int. Cl.[7] ..... D03D 15/00

(52) U.S. Cl. ..... 442/229; 2/901; 424/402; 424/404; 428/549; 428/363; 428/365; 428/377; 428/375; 428/378; 428/907; 442/123; 442/208; 442/209; 442/211; 442/212; 442/214; 442/316; 442/377

(58) Field of Search ..... 2/901; 424/402, 424/404; 442/123, 229, 208, 209, 211, 212, 214, 316, 377; 428/549, 363, 365, 377, 375, 378, 907

(56) References Cited

FOREIGN PATENT DOCUMENTS 59-012626 * 9/1988 (JP) .
63-219646 * 9/1988 (JP) ..... D03D/1/00
6-017334 * 1/1994 (JP) ..... D02G/65/40
6-297626 * 10/1994 (JP) ..... D03D/15/00
7-109672 * 4/1995 (JP) ..... D03D/15/00

* cited by examiner

*Primary Examiner*—Blaine Copenheaver
*Assistant Examiner*—Arti R. Singh
(74) *Attorney, Agent, or Firm*—Oblon, Spivak, McClelland, Maier & Neustadt, P.C.

(57) ABSTRACT

A food wrapping cloth comprises a fabric serving as a material and formed of a warp and a weft; the warp being composed of a cellulosic fiber yarn and a twist yarn formed by twisting an antibacterial yarn with a cellulosic fiber yarn, the antibacterial yarn being formed by depositing an antibacterial metal on a synthetic resin film and cutting the antibacterial metal deposited on the synthetic resin film to be a fine and long yarn; and the weft being composed of a cellulosic fiber yarn.

1 Claim, 3 Drawing Sheets

FOOD WRAPPING CLOTH

TECHNICAL FIELD

The present invention relates to a wrapping cloth for directly wrapping a food such as fish, meat, vegetable, and which absorbs water, blood, juice, etc. oozing out from the surface of the food, thereby keeping the surface dry and sterilizing bacteria stuck to the surface to improve a hygienic condition of the food.

BACKGROUND ART

From the second or third century A.D., it has been known that silver exhibits an antibacterial effect and, therefore, silver products have been employed as tableware including silver plates. To make one's living environment more hygienic and healthy using such an antibacterial action of the metal capable of performing ion exchange, a variety of antibacterial products or goods have been hitherto proposed. For example, the Japanese Laid-Open Patent Publication (unexamined) No. Hei 6-297629 discloses an antibacterial cloth.

The antibacterial cloth according to this prior art comprises: an inner layer member of which water absorbing performance is improved by mixing an inorganic antibacterial agent containing copper ion, etc. into an urethane foam resin; and a cloth-like outer layer member composed of a cotton yarn serving as a weft formed by entangling an extra fine metallic yarn of copper or the like and a rayon yarn serving as a warp.

However, following problems exist in the mentioned antibacterial cloth.

First, since the extra fine metallic yarn is employed, the antibacterial cloth is heavy and hard. Further, the extra fine metallic yarn is easy to cut, and therefore it is difficult to wash the cloth to use it repeatedly, and there may arise a further problem of injuring a user due to the cut metallic yarn.

If the mentioned extra fine metallic yarn is incorporated as a warp, there arise disadvantages such that the yarn is easy to cut, making it difficult to warp and weave the yarn, and the resultant cloth itself becomes hard due to hardness of the metal, and therefore the extra fine metal can be used only as a weft. Even used only as a weft, the metallic yarn is not resistant to a high speed weave or fabrication, which results in a low productivity, and since the surface of the cloth is coated with the extra fine metallic yarn, the water absorbing property of the cellulosic fiber yarn is sacrificed, eventually affecting the deodorizing performance.

Moreover, in spite of the necessity of keeping the antibacterial cloth in contact with an object continuously for a certain time in order that the antibacterial cloth exhibits an antibacterial performance, there is no consideration about the proper wrapping of a food with such an antibacterial cloth in the aforementioned patent publication. It is stated in the patent publication that when using the antibacterial cloth, an effect is instantaneously produced. It is, however, known from some experimental data that any sufficient antibacterial effect is not exhibited without keeping continuously for a certain time the antibacterial cloth in contact with a portion where antibacterial effect is expected. If any antibacterial effect is exhibited on the water or dust wiped out from the portion where the antibacterial cloth contacts, it is useless and means nothing.

Accordingly, an object of the invention is to provide food wrapping cloth in which antibacterial and sterilizing effect is sufficiently performed, and which is soft, light and capable of being used repeatedly.

DISCLOSURE OF INVENTION

To accomplish the foregoing object, a food wrapping cloth according to the invention comprises a fabric serving as a material and formed of a warp and a weft; said warp being composed of a cellulosic fiber yarn and a twist yarn formed by twisting an antibacterial yarn with a cellulosic fiber yarn, said antibacterial yarn being formed by depositing an antibacterial metal on a synthetic resin film and cutting the antibacterial metal deposited on the synthetic resin film to be a fine and long yarn, and said weft being composed of a cellulosic fiber yarn.

BEST MODE FOR CARRYING OUT THE INVENTION

A best mode for carrying out the invention is hereinafter described with reference to the drawings.

Figure 1:
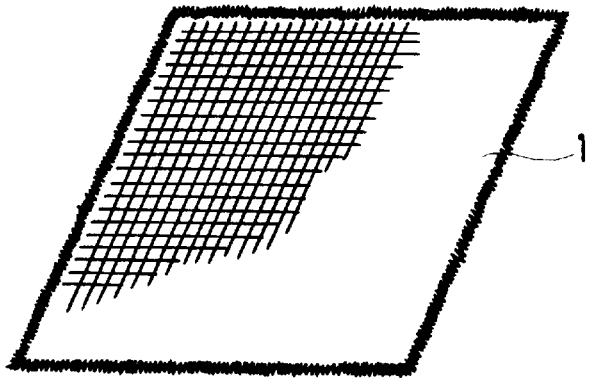
FIG. 1 is a perspective view showing an example of the food wrapping cloth according to the invention.

FIG. 1 is a perspective view showing a food wrapping cloth 1 according to the invention, and the food wrapping cloth 1 has a warp which includes a twist yarn 2 formed by twisting an antibacterial yarn 21 and a cellulosic fiber yarn 22.

The antibacterial yarn 21 is produced by depositing an antibacterial metal on a synthetic resin film by ion deposition or the like and cutting to be 0.1 to 1.0 mm in width. The antibacterial metal is a metal having an antibacterial property and capable of performing ion exchange such as silver, copper, zinc, etc. Among these metals, silver is most preferable because of its high corrosion resistance. The mentioned synthetic resin film is a film composed of polyester, polyethylene, polypropylene or the like and 10 to 100 microns in thickness.

Figure 2:
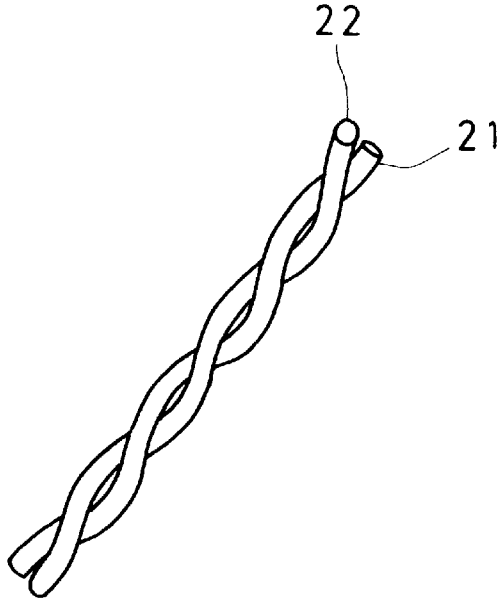
FIG. 2 is a schematic perspective view showing an arrangement of a twist yarn serving as a material of the mentioned food wrapping cloth.

The twist yarn 2 is produced by twisting the antibacterial yarn 21 and the cellulosic fiber yarn 22 one by one as shown in FIG. 2. In this respect, the cellulosic fiber yarn 22 is a yarn composed of a natural fiber such as cotton, hemp, jute, and an artificial fiber such as rayon, acetate, cupra, lyocel (not defined), and yarn number thereof is 5 to 100 count. In addition, cellulosic fiber yarns 3 and 4 described later are same as the cellulosic fiber yarn 22.

Figure 3:
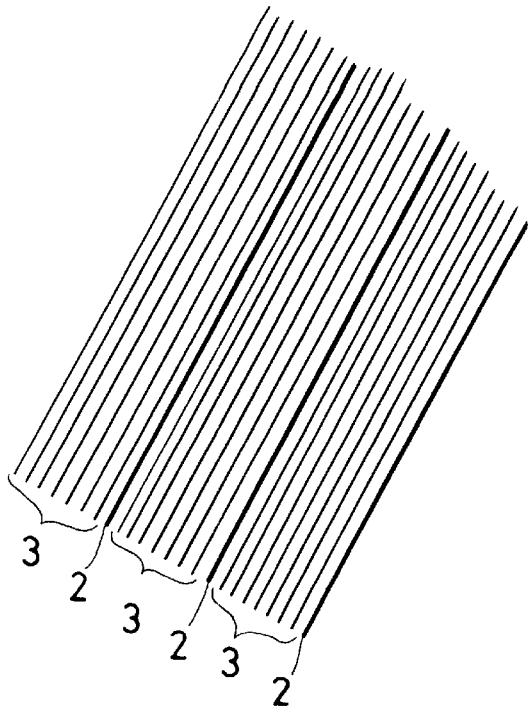
FIG. 3 is a schematic view showing an arrangement of the warp.

The twist yarn 2 is warped so as to have an equal distance between one twist yarn 2 and another each being put between the cellulosic fiber yarns 3 as shown in FIG. 3. With regard to the ratio, 1 to 10 twist yarns 2 and 40 to 100 cellulosic fiber yarns 3, being about 110 yarns in total, are used per inch in cloth width.

Figure 4:
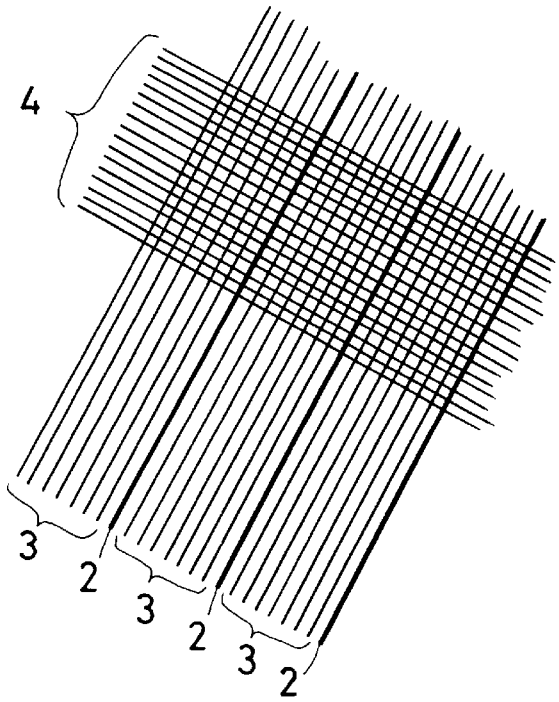
FIG. 4 is a schematic view showing an arrangement of the weft woven into the warp.
Figure 5:
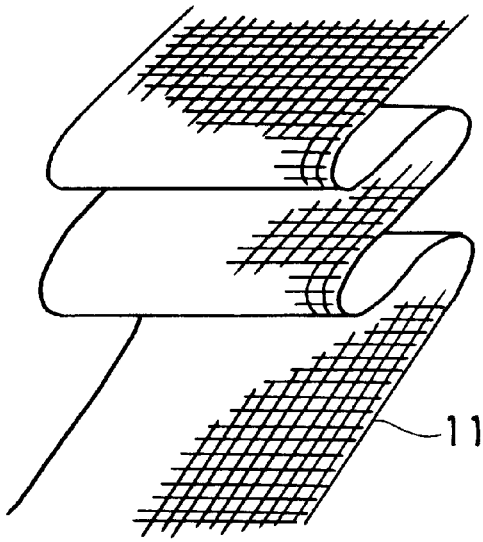
FIG. 5 is a perspective view of a material cloth produced by weaving.
Figure 6:
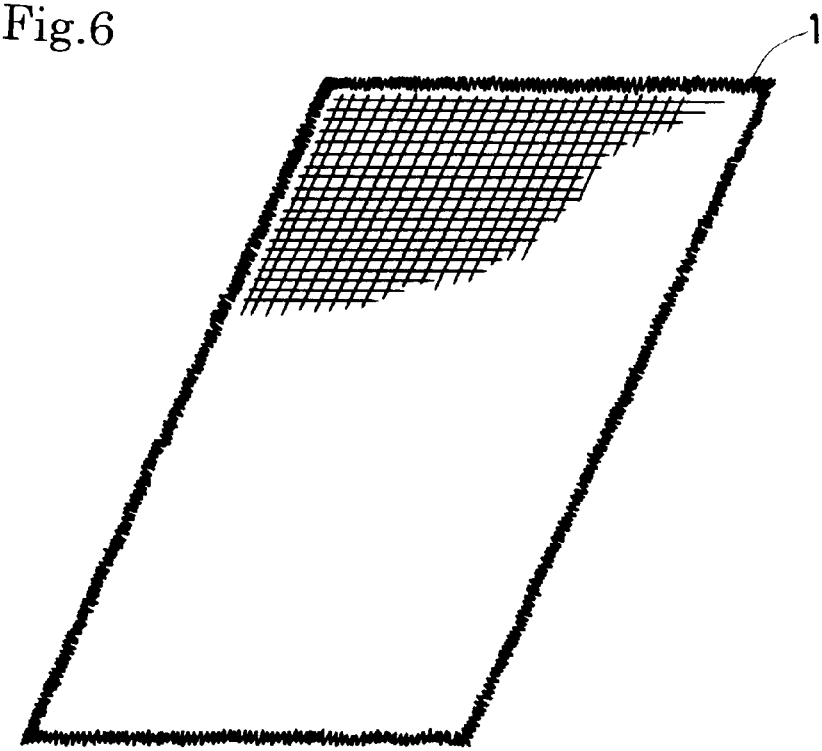
FIG. 6 is a perspective view showing a further example of the invention.

As shown in FIG. 4, about 40 to 80 cellulosic fiber yarns 4 serving as weft are woven by automatic weaving machine into the mentioned warped yarns per inch in cloth width, whereby a material cloth 11 of plain weave is obtained as shown in FIG. 5. Other than the form of plain weave, the material cloth 11 is produced in the form of a fabric made by twill weave, sateen weave, leno cloth, or in the form of a knit by tricot, raschel, milanese, weft knit, tubular knit, or in the form of a knit and fabric by Karl Mayer method.

The material cloth 11 is cut to be a size of handkerchief, kerchief, towel, etc. and by bordering the cut edge, a food wrapping cloth 1 is obtained.

By directly wrapping a food with the food wrapping cloth 1 produced as mentioned above, portion of the cellulosic fiber yarn 22 and the cellulosic fiber yarns 3 and 4 absorb water on the surface of the food to accelerate drying, and therefore bacteria is restrained from increase or breeding, eventually resulting in exhibition of a deodorizing performance. The antibacterial metal portion of the antibacterial yarn 21 in direct contact with the food exhibits an antibacterial and sterilizing performance due to a potential difference of ion generated therefrom, which contributes to the maintenance of food quality. Further, as the antibacterial yarn 21 is flexible, light and difficult to cut, being different from the extra fine metallic yarn, it is possible to be used repeatedly by washing or cleaning, and even if the antibacterial yarn 21 should be cut, there is no possibility of injuring the user. In the food wrapping cloth 1, since the antibacterial yarn 21 is used as warp, a higher productivity is assured.

EXAMPLE (1) Production of antibacterial yarn and twist yarn

An antibacterial yarn was produced by depositing silver ion on a polyester film (produced by Toyobo Co.,Ltd.) of 30 microns in thickness by ion deposition and cutting to be a fine and long yarn of 0.5 mm in width. Then, a twist yarn was produced by winding the antibacterial yarn 300 times per meter round a 30 count rayon yarn and twisting.

(2) Production of Food Wrapping Cloth

The twist yarn produced in the foregoing (1) and the 30 count rayon yarn were warped with an interval of 5 mm so that 7 twist yarns and 43 30 count rayon yarns are respectively arranged per inch in cloth width.

Yarns of 20 count lyocel(not defined) (trade name (registered trademark): Tencel produced by Tuzuki Boseki Co.,Ltd.) were woven as weft by automatic weaving machine so that 50 yarns are arranged per inch in cloth width, thereby a fabric being obtained.

(3) Antibacterial Performance Test

An antibacterial performance test was carried out by the Osaka Food Hygiene Association Food Inspection Center in accordance with a working effect evaluation test (bacteria number measurement method) of the Fiber Product Healthy Work Council. In this test, 0.4 g (about 9 $cm^2$) of the antibacterial cloth cut out from the fabric produced in the foregoing (2) was used as a test sample of the food wrapping cloth according to the invention. 0.4 g of gauze composed of 40 count cotton yarn by 100% was also used as a control (comparative example). In addition, a following strain was used as test bacteria.

Test strain: *Escherichia coli*157:H7 (*Escherichia coli*157 provided by the Osaka Prefecture Public Health Laboratory)

Table 1 show numbers of survived bacteria immediately after the inoculation and after cultivating 18 hours at 35° C. respectively counted in accordance with the mentioned evaluation test method.

TABLE 1

| | Evaluation time | |
|---|---|---|
| Test sample | Immediately after inoculation | After cultivating 18 Hours at 35° C. |
| Antibacterial cloth | $1.0 \times 10^5$ | $5.4 \times 10^2$ |
| Gauze of 100% cotton (control) | $1.0 \times 10^5$ | $7.4 \times 10^7$ |

As is understood from the above Table 1, when comparing the numbers of survived bacteria after inoculating the same number of test bacteria and cultivating 18 hours at 35 °C., the number of bacteria survived on the antibacterial cloth is about $1/10^5$ of that survived on the gauze of 100% cotton which is a control, thus a sufficient antibacterial performance being acknowledged.

INDUSTRIAL APPLICABILITY

As has been described so far, in the food wrapping cloth according to the invention, since the twist yarn formed by twisting an antibacterial yarn with a cellulosic fiber yarn is employed, the antibacterial yarn being formed by depositing an antibacterial metal on a synthetic resin and cutting the antibacterial metal deposited on the synthetic resin to be a fine and long yarn, when wrapping a food directly with the food wrapping cloth, a superior antibacterial and sterilizing effect is performed at and around the portion of the antibacterial metal directly in contact with the food. Further, since the cellulosic fiber yarns are employed in both warp and weft, water on the surface of the food is absorbed by the cellulosic fiber yarns to accelerate drying, whereby any bacteria is restrained from increase or breeding, eventually resulting in deodorization effect. Furthermore, the twist yarn is light, strong and flexible, being different from the extra fine metallic yarn, and by employing such a twist as warp, utility as a food wrapping cloth is successfully exhibited.

What is claimed is:

1. A food wrapping cloth comprising a fabric serving as a material and formed of a warp and a weft; said warp being composed of a cellulosic fiber yarn and a twist yarn formed by twisting an antibacterial yarn with a cellulosic fiber yarn, said antibacterial yarn being formed by depositing an antibacterial metal on a synthetic resin film and cutting the antibacterial metal deposited on the synthetic resin film to be a fine and long yarn; and said weft being composed of a cellulosic fiber yarn.

* * * * *